US009019059B2

(12) United States Patent
Nomura et al.

(10) Patent No.: US 9,019,059 B2
(45) Date of Patent: Apr. 28, 2015

(54) MULTI-TURN HIGH DENSITY COIL AND FABRICATION METHOD

(71) Applicant: Toyota Motor Engineering & Manufacturing North America, Inc., Erlanger, KY (US)

(72) Inventors: Tsuyoshi Nomura, Ann Arbor, MI (US); Jae Seung Lee, Ann Arbor, MI (US); Kayoko Seto, Toyota (JP)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 13/902,121

(22) Filed: May 24, 2013

(65) Prior Publication Data

US 2014/0347155 A1 Nov. 27, 2014

(51) Int. Cl.
*H01F 5/00* (2006.01)
*H01F 27/28* (2006.01)

(52) U.S. Cl.
CPC ..... *H01F 27/2847* (2013.01); *Y10T 29/4902* (2015.01)

(58) Field of Classification Search
USPC ..... 336/65, 83, 200, 232, 221, 225
See application file for complete search history.

(56) References Cited

U.S. PATENT DOCUMENTS

| | | | | |
|---|---|---|---|---|
| 6,927,660 | B2 * | 8/2005 | Okamoto | 336/192 |
| 7,173,508 | B2 | 2/2007 | Anbo et al. | |
| 7,199,693 | B2 * | 4/2007 | Matsutani et al. | 336/200 |
| 8,237,535 | B2 * | 8/2012 | Hollevoet et al. | 336/200 |
| 2003/0052767 | A1 | 3/2003 | Yamanobe et al. | |

* cited by examiner

*Primary Examiner* — Tuyen Nguyen
(74) *Attorney, Agent, or Firm* — Christopher G. Darrow; Young Basile Hanlon & MacFarlane P.C.

(57) ABSTRACT

A multi-turn electrical coil and fabrication method uses a plurality of identically constructed flat electrical conductors, alternating ones of which carry an electrically insulating material layer on one major surface. The bare conductors and the insulated conductors are alternatingly stacked about mounting posts in partially overlapped and partially laterally offset pairs of conductors, with each conductor in each conductor pair reoriented relative to the other conductor in the respective conductive pair, and alternating conductor pairs reoriented relative to adjacent conductor pairs, to form a spiral winding turn for the coil.

12 Claims, 8 Drawing Sheets

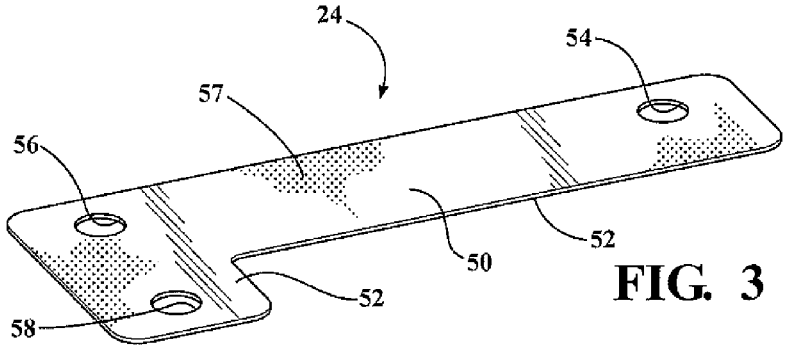
FIG. 3
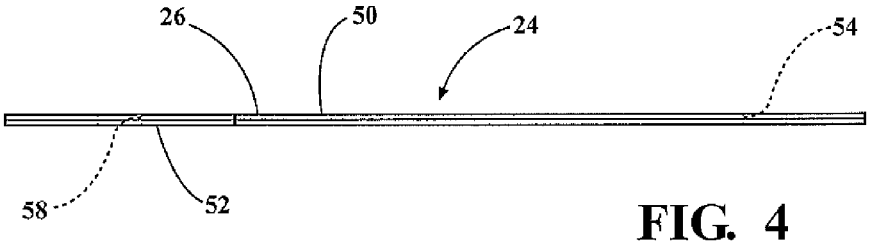
FIG. 4
FIG. 5B
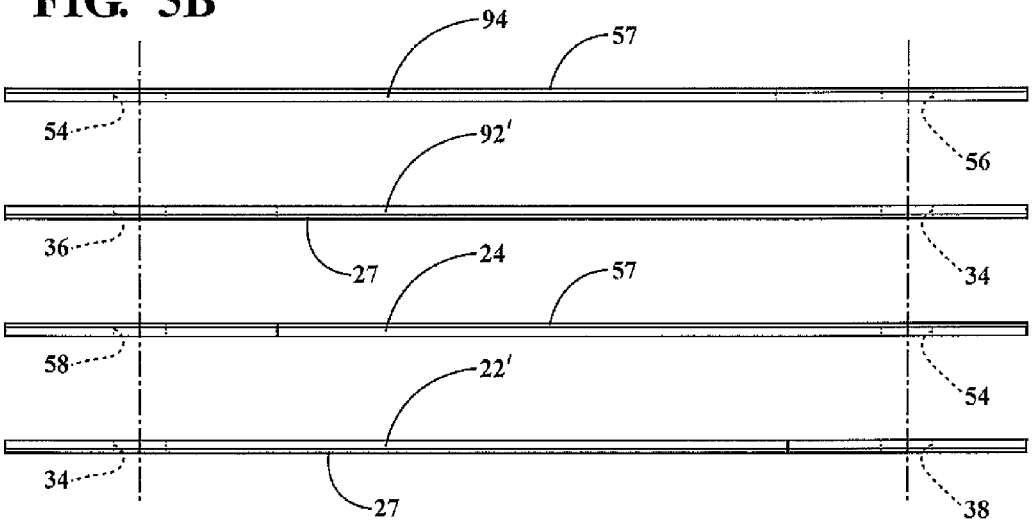

MULTI-TURN HIGH DENSITY COIL AND FABRICATION METHOD

BACKGROUND

The present multi-turn high density coil and fabrication method relates to coils used in electrical and electronic equipment, such as inductors and transformers and, particularly, to coils in use for electrical and electronic devices formed of stacked layers of interconnected conductors.

Windings forming coils for an inductor or a transformer are used in electrical and electronic equipment. Such equipment usually has volume-restricted space requirements thereby requiring that such coils or windings have a low profile.

In order to achieve the low profile and minimal space requirements for such coils, the fill factor of the windings of the coils needs to be maximized so that the maximum amount of current carrying conductors completely a given space.

Planar magnetics i.e., inductors or transformers, has recently gained interest due to performance, space utilization and fabrication efficiency. For planar magnetics, there are three general methods of building coil windings. The first one is a conventional wire winding process, where edgewise winding can be used to make a planar coil. However, this process has limitations in shape or configuration of the end structure. It is further difficult to have tightly wound coils or wide flat coils, especially with edgewise winding, since the coils are processed from thick copper wire.

A second planar magnetic winding technique is to use PCB or semiconductor fabrication processes. The winding structure is built using a metal deposition or plating and etching processes. This fabrication method has a limitation in conductor fill factor which is important to maximize DC performance, since metal thickness is limited. In addition, interlayer connection parts have to be prepared using additive metallization such as through hole or side metallization to form a coil with a large number of turns. Such additive processes are usually complicated and show poor conductivity.

The third winding fabrication method uses bus bars for single or several winding structures which are machined out of thick copper plate and built into a coil structure by welding or soldering. The problem of bus bar type construction is that it requires not only machining, but also bending, welding, or soldering.

SUMMARY

A coil for an electrical and/or electronic device includes a spiral wound electrical conductors coil formed by a plurality of vertically stacked conductors, each having a linear shape and arranged in pairs of conductors. Each pair of conductors includes a first bare conductor and a second conductor having an electrically insulating material layer on one major surface. The conductors are inverted relative to each other to form each pair of conductors with a bare exposed portion of the pair of conductors extending outward from each pair of conductors. Partially laterally offsetting and laterally overlapping alternating pairs of conductors, with the bare exposed outwardly extending portions of each pair of conductors contact a stacked bare conductor portion of an adjacent pair of conductors to complete a spiral turn in the coil.

The coil has two sets of non-conductive posts. The conductors mounted over the posts. Connectors are engageable with the posts for forcing the stacked arrangement of conductors into electrical contact to form at least one spiral turn of the coil.

In one aspect, each conductor may have long leg portion and angularly disposed short leg portion extending from an end portion of the long leg portion.

Each conductor may have an L-shape with a long leg portion and a short leg portion, the short leg portion extending perpendicularly from one end of the long leg portion.

Two pairs of stacked, partially overlapping and partially laterally offset pairs of conductors form a single spiral winding turn with a centrally disposed aperture between the stacked pairs of conductors.

Alternating conductors have an electrically insulating material layer on one major surface.

In one aspect, alternating conductors are reoriented relative to adjacent stacked conductors.

In another aspect, the plurality of flat conductors are arranged in stacked pairs of conductors, with each conductor in each pair of conductors inverted in orientation relative to the other conductor in each pair of conductors. Each pair of conductors are inverted in orientation relative to adjacent stacked pairs of conductors.

A method of forming a coil for an electrical/electronic device positioning includes:

providing two sets of posts, each set including three co-linear posts, the two sets of post spaced apart co-linearly in parallel;

providing a plurality of identically shaped flat electrical conductors, including one bare conductor, with alternating second conductors having an electrically insulating layer on one major surface;

mounting a first bare conductor about selected ones of sets of posts;

reorienting a second conductor carrying the electrically insulating surface relative to the first bare conductor and mounting the second conductor over the first conductor on the selected posts of the sets of mounting posts;

mounting a third bare conductor reoriented from the orientation of the first bare conductor in the first pair of conductors over selected posts of the sets of posts partially overlapping and partially laterally offset from the first pair of conductors;

mounting a fourth conductor carrying an electrically insulating material layer on one major surface over the third conductor, reoriented relative to the third conductor; and urging exposed end portions of the first, second, third and fourth conductors into electrical contact to form a single spiral turn in the coil.

The coil further includes an input terminal coupled to one of the plurality of conductor and an output terminal coupled to another one of the plurality of conductors.

The method also includes the step of forming a transformer by mounting the coil in magnetic relationship with a magnetic core.

BRIEF DESCRIPTION OF THE DRAWING

The various features, advantages and other uses of the present multi-turn coil will become more apparent by referring to the following detailed description and drawing in which:

FIG. 3 is an enlarged perspective view of another conductive having an electrical insulating layer on one surface for use in the coil shown in FIG. 1;

FIG. 4 is a side elevational view of the conductor shown in FIG. 3;

FIG. 5B is an exploded, side elevational view, similar to FIG. 5A, but showing an alternate construction for the conductors;

DETAILED DESCRIPTION

Referring now to FIGS. 1-11, a coil 20 is illustrated which is useable in electrical/electronic devices as an inductor or a transformer.

The coil 20 is formed of a plurality of spiral turns of an electrical conductor, with the number of turns, as well as the size (length, width and thickness) of the electrical conductors being chosen to suit the particular current and voltage requirements of a particular electrical/electronic application.

Figure 2:
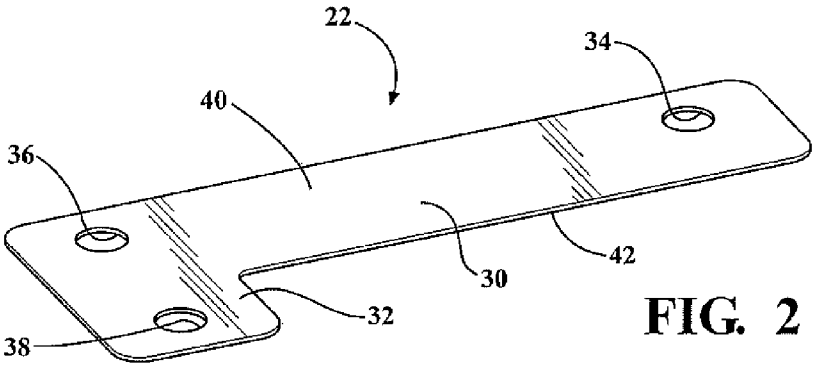
FIG. 2 is an enlarged perspective view of a bare conductor used in the coil depicted in FIG. 1.
Figure 5A:
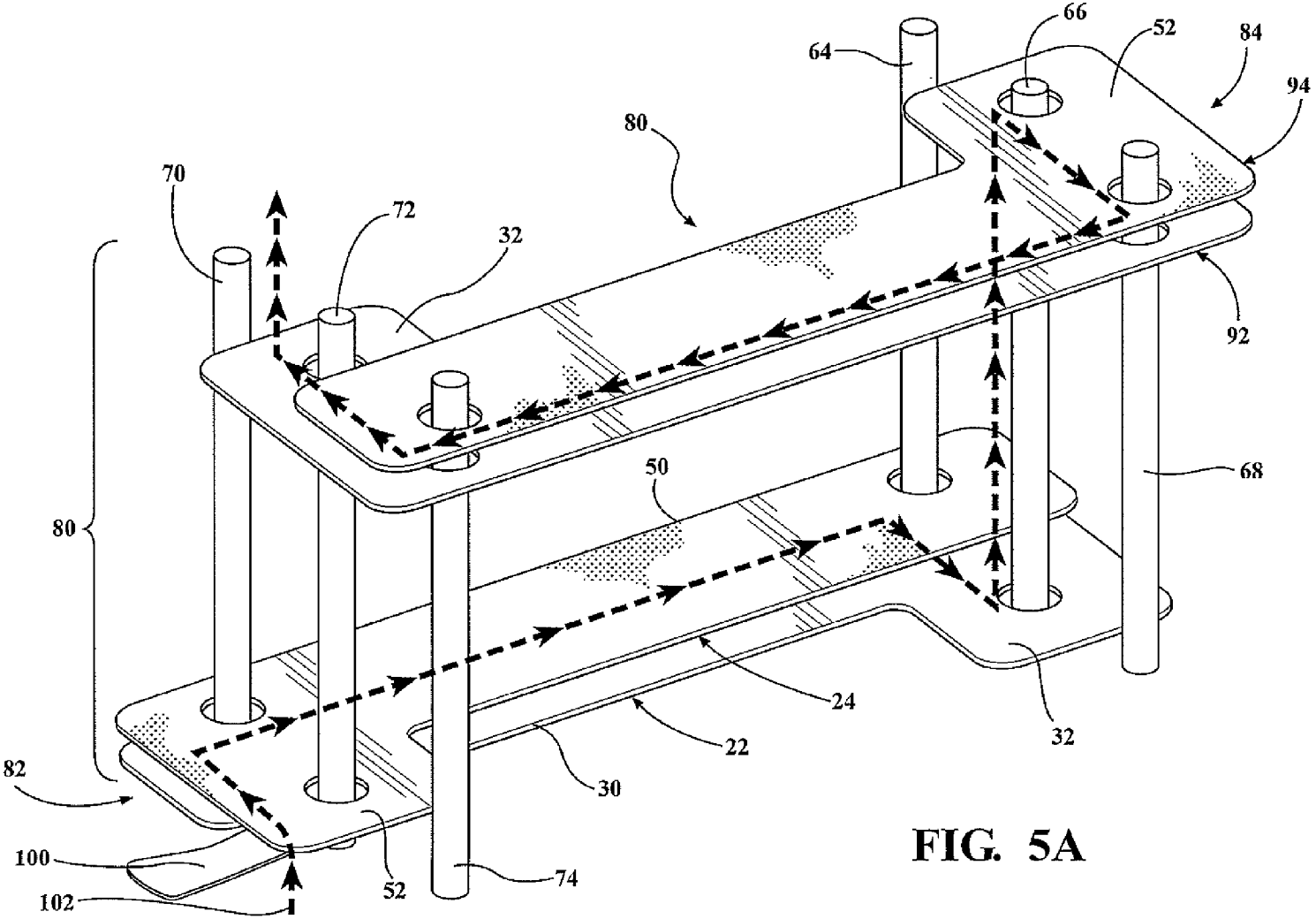
FIG. 5A is a partial, exploded perspective view showing a single spiral turn coil forked of a plurality of stacked conductors.

The coil 20 is constructed of a spiral-stacked arrangement of a plurality of identical electrical conductors 22 and 24, as shown in detail in FIGS. 2, 3, and 4. The conductors 22 and 24 are substantially identical in shape and size, with the only difference being that the conductor 24 has an electrical insulating material layer 26 applied to one major surface.

Although the conductors 22 and 24 will be described hereafter as being in the form of plates or bus bars, in one aspect, the conductors 22 and 24 are in the form of thin foil like strips formed of an electrically conductive material, such as copper, copper alloy, etc. The thin thickness of the conductors 22 and 24 enables selective bare ends of the individual conductors 22 and 24, as described hereafter, to be urged together into electrical contact under the force of connectors.

The conductors 22 and 24 may also assume a variety of shapes with the L-shape conductors shown in FIGS. 2 and 3 being understood to be an example of a number of possible shapes that the conductors 22 and 24 may take. The conductors 22 and 24 can be stamped, machined or otherwise formed in the illustrated L-shape.

Thus, in the aspect of the conductors 22 and 24 shown in FIGS. 1-8, each conductor 22 and 24 has a longer leg 30 and an integral short leg 32 which projects from one end of the longer leg at a generally perpendicular angle. An aperture 34 is formed at one end of the long leg 30. A pair of apertures 36 and 38 is formed at the opposite end of the conductor 22 at one end of the longer leg 30 and the short leg 32. The conductor 22 is bare, that is, both major surfaces, including the top surface 40 and the bottom surface 42, are bare of electrical insulation.

The other conductor 24 is identically constructed with a longer leg 50, and a shorter leg 52 extending from one end of the longer leg 50 at a generally perpendicular angle. A first aperture 54 is formed in one end of the longer leg 50. A pair of apertures 56 and 58 is foliated at the other end of the conductor 24, one aperture 56 in one end of the longer leg 50 and one aperture 58 in the shorter leg 52.

As shown in FIG. 4, the conductor 24 includes an underlying bare conductor portion 25, identical in shape, size, and thickness as the other bare conductor 22, as well as a layer of electrical insulating material 57, which is coated or adhesively joined to one major surface of the conductor 24. The side edges of the conductor 24 do not have to be covered by the electrically insulating material layer applied to one surface of the bare conductor portion 25 of the conductor 24.

The conductors 22 and 24 may take other shapes, such as a more rounded, C-shape, with one end being longer than the opposite end of the C-shaped conductor.

In order to create the stacked arrangements of spiral arranged, interleaved conductors 22 and 24, two sets 60 and 62 of parallel, spaced, non-electrically conductive supports or posts are provided as shown in FIGS. 5A-7. The first set 60 of posts includes first, second and third posts 64, 66 and 68. The second set 62 of posts includes posts 70, 72 and 74. The posts 64, 66, 68, 70, 72 and 74 in the two sets 60 and 62 of posts are arranged in a spaced apart, generally in an in-line, spaced co-linear manner within each set 60 and 62 and aligned with one opposite post in the other set 62 or 60. For example, post 64 in the first set 60 of posts is co-linear with post 70 in the second set 62 of posts. Similarly, the post 66 is co-linear with the post 72 and the post 68 is co-linear with the post 74. The individual posts 64, 66, and 68 in the first set 60 of posts are co-linear with each other. Similarly, the posts 70, 72, and 74 in the second set 62 of posts are co-linear with each other.

The formation of a single spiral turn 80 of the coil 20 will now be described in conjunction with FIGS. 5A, 6A, 6B, 6C and 6D. In constructing the single spiral turn 80 of the coil 20, a first conductor pair 82 including the first and second conductors 22 and 24 is used along with a second conductor pair 84 of like third and fourth conductors 92 and 94. The first and second conductor pairs 82 and 84, respectively, are identically constructed, and the first and second conductor pairs 82 and 84 are stacked, but with the second conductor pair 84 reoriented or reversed in orientation relative to the first conductor pair 82 to form a generally polygonal shaped, single turn spiral winding with a central aperture 86, shown in FIGS. 1, 6D and 7.

Figure 6A:
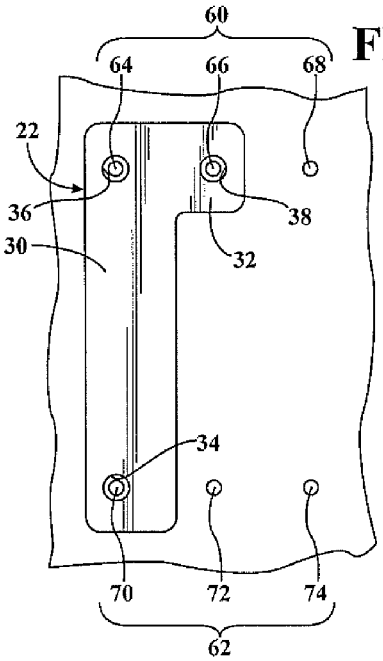
FIGS. 6A, 6B, 6C and 6D depict sequential fabrication steps to form the single spiral turn coil shown in FIG. 5.

As shown in FIGS. 6A-6D, the first step in forming the coil 20 is to mount the first conductor 22 of the first conductor pair 82 over the posts 64, 66, and 70, with the short leg 32 of the conductor 22 oriented so that the apertures 36 and 38 are respectively mounted over the posts 66 and 64 as shown in FIG. 6A.

Figure 6B:
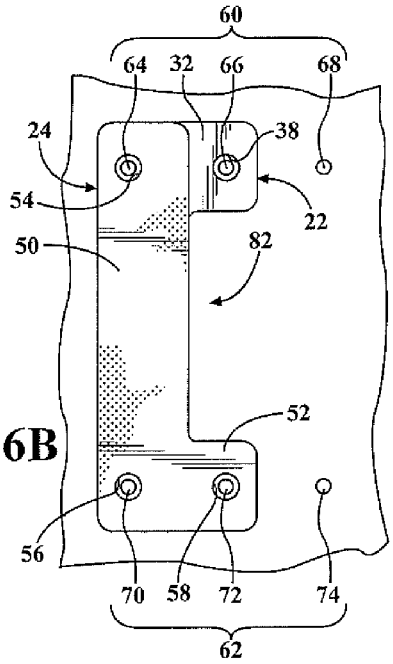

Next, the second conductor 24 of the first conductor pair 82 is mounted over the first conductor 24 by reversing or reorienting the position of the short leg 32 of the second conductor 24 so that the apertures 56 and 58 in the shorter leg 32 of the second conductor 82 are respectively mounted over the posts 70 and 72, with the aperture 54 at the end of the longer leg 50 of the second conductor 24 mounted over the post 64 as shown in FIG. 6B. In this orientation, the electrical insulation layer 57 on the second conductor 24 faces upward away from the underlying first conductor 22.

The inverting, reversing or reorienting the position of the conductors 22 and 24 of the first conductor pair 82 and the first and second conductors 92 and 94 of the second conductor pair 84 means that the second conductor 24 of the first conductor pair 82 is maintained in the same planar orientation as the first conductor 22, but rotated 180° from the orientation from the first conductor 22 so that the short leg 52 of the second conductor 24 is longitudinally spaced from the short leg 32 of the first conductor 22 as shown in FIG. 6B. The same inverting, reversing or reorienting applies to the first and second conductors 92 and 94 of the second conductor pair 84, as shown in FIGS. 6C and 6D.

It can be seen in FIG. 6B that, in this orientation, the longer legs 30 and 50 of the first and second conductors 22 and 24 overlay each other. The short leg 32 of the first conductor 24 extends laterally outward from one end of the stacked first conductor pair 82 and the short leg 32 of the second conductor 24 extends laterally outward from the opposite end of the stacked first conductor pair 82.

Figure 6C:
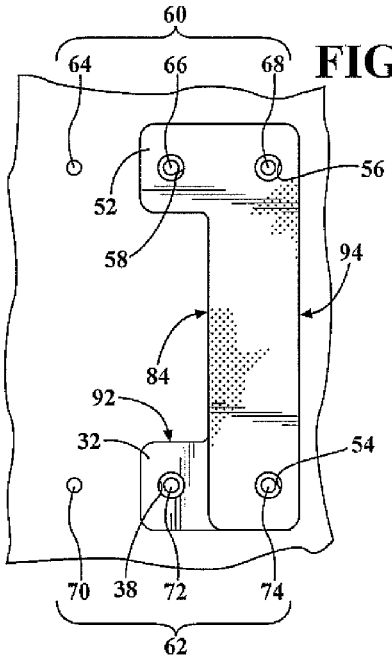
Figure 6D:
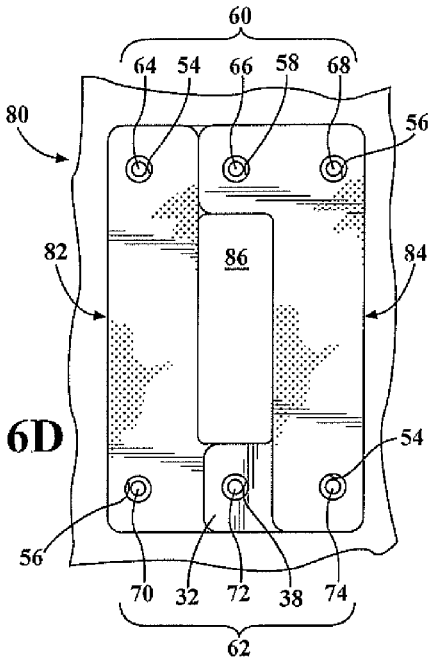

Next, the second pair of conductors 84, including a third conductor 92, identical to the first conductor 22 and a fourth conductor 94 identical to the second conductor 24 and carrying an electrically insulating material layer 57 are individually stacked over the sets 60 and 62 of mounting posts as shown in FIG. 6C. It should be noted that, for clarity, the underlying first conductor pair 82, which have been previously mounted on the posts 64, 66, 70 and 72, shown in FIGS. 6A and 6B, is not depicted; but it will be understood to be underlying the second conductor pair 84.

The third conductor 92, which is bare, is oriented so that the aperture 34 in the longer leg 30 is positioned to engage the post 68 in the first set 60 of posts, so that the bare portion formed by the short leg 32 of the third conductor 92 is spaced from the bare portion formed by the short leg 32 of the bare first conductor 22 in the first pair of conductors 82. The fourth conductor 94 is reoriented or reversed in position from the position of the third conductor 92 so that the apertures 56 and 58 in the short leg 52 are positioned to be mountable over the posts 66 and 68 in the first set 62 of posts. The aperture 54 at the end of the longer leg 50 of the fourth conductor 94 is mounted over the third post 72 in the second set 62 of posts.

The term "reversing, inverting or reorienting" the position of the third and fourth conductors 92 and 94 is the same as applied to the conductors 22 and 24 of the first conductor pair 82. In addition, the second conductor pair 84 is also inverted, reversed or reoriented with respect to the first conductor pair 82 so that the short leg 32 of the third conductor 92 is longitudinally spaced from the short leg of the first conductor 22. Similarly, the short leg 52 of the fourth conductor 94 is longitudinally spaced from the short leg 52 of the leg second conductor 24.

It should be noted in comparing FIGS. 6A and 6B, that each half of a single spiral turn of the coil 20 has a bare exposed portion formed by the short leg 32 of the first or third conductors 22 or 92 at one end of the conductor pairs 80 and 82. The bare exposed portions of the short legs 32 of the conductors 22 and 92 are positioned to engage the underlying bare surface of the second or fourth conductors 24 and 94, respectively due to the axial arrangement of the short leg portions of the conductors over the second posts 66 and 72 of the two pairs 60 and 62 of mounting posts.

FIG. 6D depicts the complete single spiral turn 80 of the coil 20 where the two conductor pairs 82 and 84 are arranged in a stacked conductor pair arrangement, partially overlapping and partially laterally offset from each other on the sets 60 and 62 of mounting posts.

As shown in FIG. 5, an input terminal 110, such as a thin foil strip or tab, can be formed on or joined to the bare underside of the short leg 52 of the second conductor 24 of the first conductor pair 82 by welding, soldering, electrically conductive adhesive, etc.

The dashed line denoted by reference number 102 in FIG. 5 depicts the current flow path through the single spiral turn 80 of the coil 20. Current applied to the input terminal 110 flows along the conductive portion of the short leg portion 52 of the second conductor 24 underlying the insulated layer 57, through the contacting conducting portions of the longer legs 30 and 50 of the first and second conductors 22 and 24 to the short leg 32 of the first conductor 22.

Figure 1:
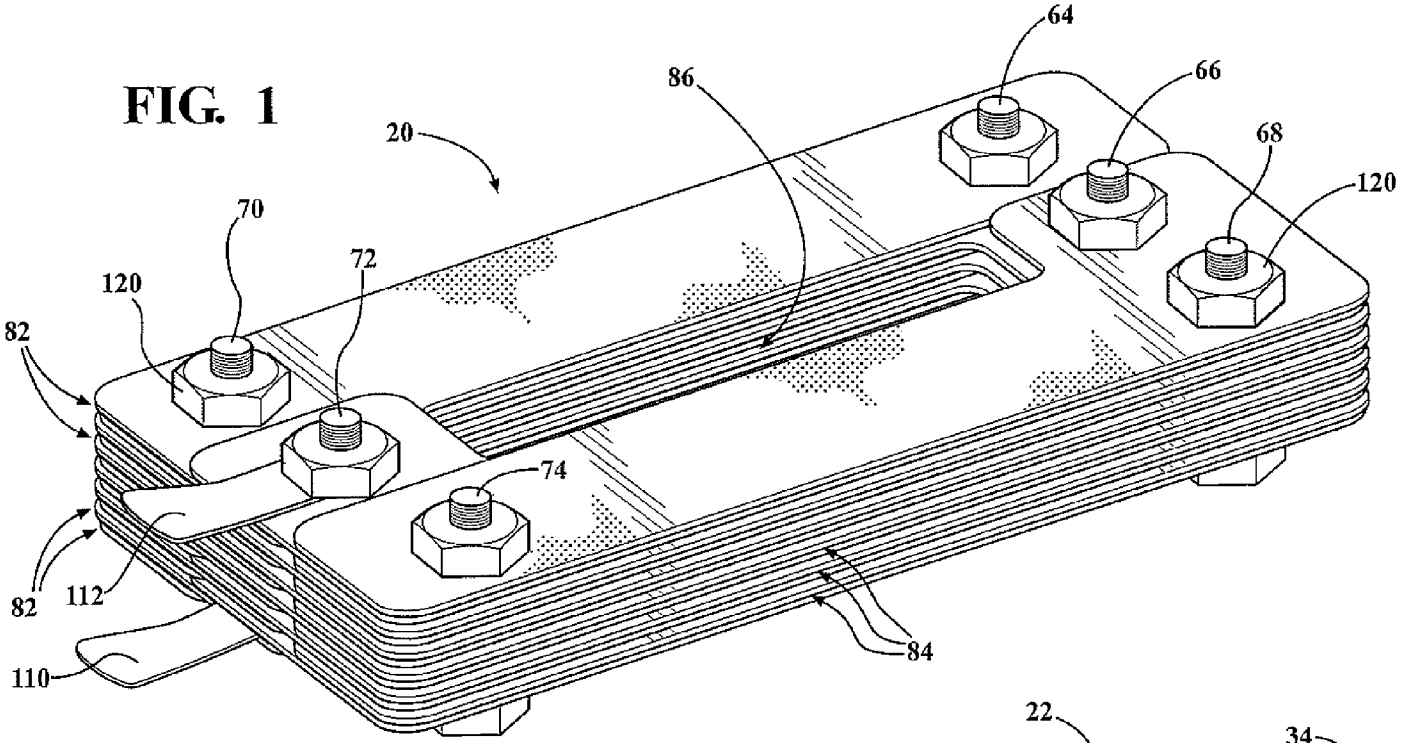
FIG. 1 is a perspective view of a multi-turn coil made in accordance with the present fabrication method.
Figure 7:
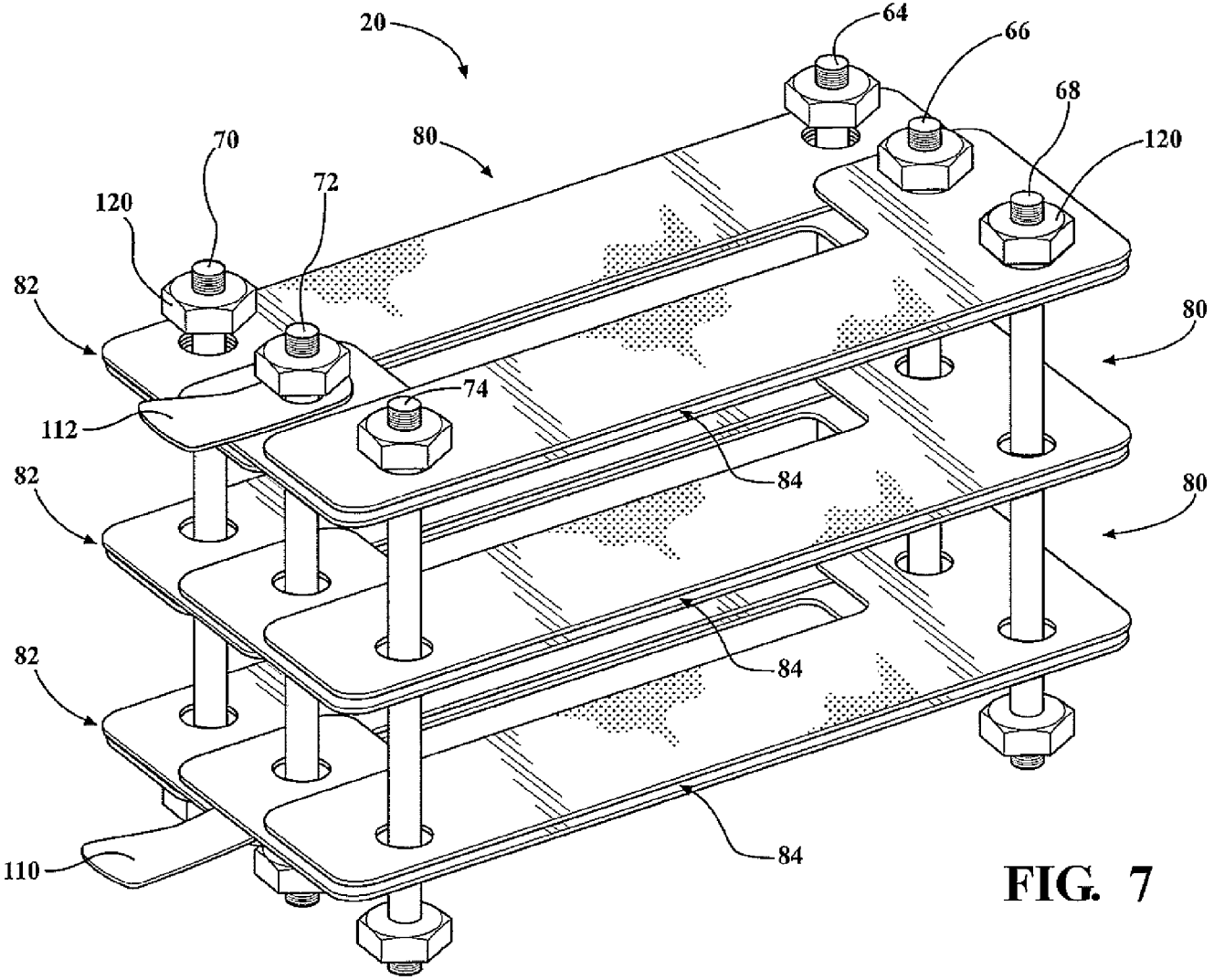
FIG. 7 is a partial, exploded view of a portion of the multi-turn coil shown in FIG. 1, with the individual spiral turns spaced apart for illustrative purposes.

As the bare exposed portion of the short leg portion 32 of the first conductor 24 axially underlies and is overlapped by the conductive portion of the short leg portion 52 of the third conductor 92, when the conductors 22, 24, 92 and 94 have been mounted on the sets 60 and 62 of posts as described hereafter and shown in FIGS. 1 and 7, the bare exposed portion 32 of the first conductor 22 contacts the conductive portion of the short leg 52 of the third conductor 92 thereby forming a current flow path between the first conductor pair 82 and the second conductor 84. The current flow path then proceeds along the third conductor 92, through the overlapped and contacting longer leg portions 30 and 50 of the third and fourth conductors 92 and 94 until it reaches the bare exposed portion of the second leg portion of the third conductor 92. An output terminal can be connected to the bare exposed or short leg 32 of the third conductor 92 or the short leg 32 of the third conductor 92 can be used as a contact point to further stacked spiral turns of the coil 20 as shown in FIGS. 1 and 7.

As shown in FIG. 7, a plurality of interconnected spiral turns 80 are provided for the coil 20, with three spiral turns 80 being shown by way of example. Each spiral turn includes an axial stacked arrangement of partially overlapped and partially laterally offset conductor pairs 82 and 84.

In FIG. 7, connectors 120, such as nuts, are mounted on threaded end portions of both ends of the posts 64, 66, 68, 70, 72, and 74. When the connectors 120 are tightened, the exposed portions of the conductor pairs 82 and 84 are urged into electrical contact to form electrical contact surfaces between the layers of each spiral turn 80 and between each of a plurality of spiral turns 80.

FIG. 5B depicts an alternate aspect of the conductors 22, 24, 92 and 94. In this aspect, the conductors 22 and 92, which were previously described as being bare or lacking electrical insulation on either major surface, can be provided with a layer 27 of insulation, identical to the insulator layer 57 provided on the conductors 24 and 94, on one major surface as shown for conductors 22' and 92'. This makes all of the conductors 22', 24, 92' and 94 identical thereby simplifying manufacturing and reducing manufacturing costs, As shown in FIG. 5B, the orientation of the conductors 22', 24', 92', and 94 in the same manner as that described above for the conductors 22 and 92, places the layer of insulation 27 on the conductors 92' in contact with the insulation layer 57 on the adjacent conductor 24.

Figure 8A:
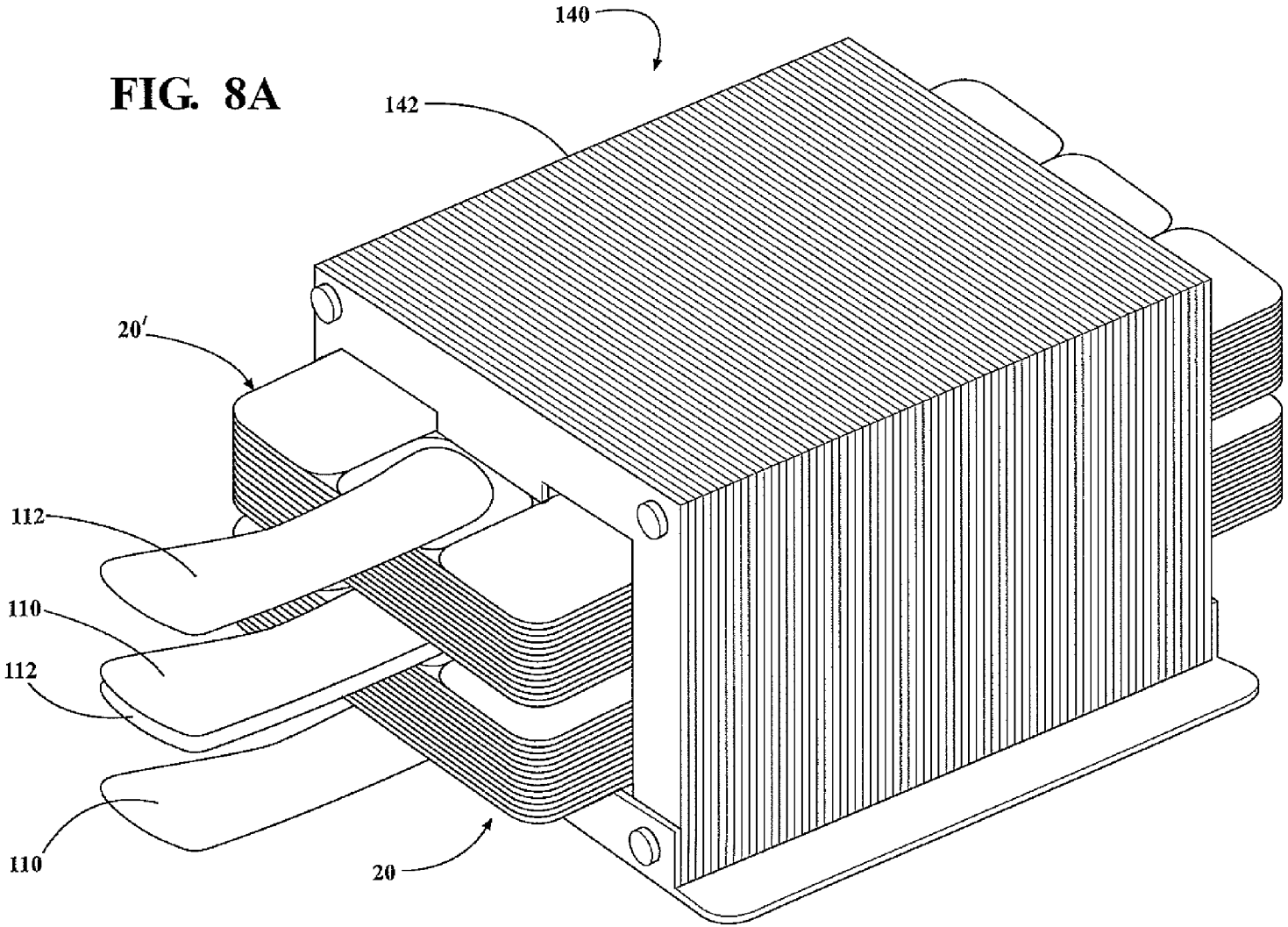
FIG. 8A is a perspective view of the multi-turn coil fabricated in accordance with the present method used with a core to form an electrical transformer.
Figure 8B:
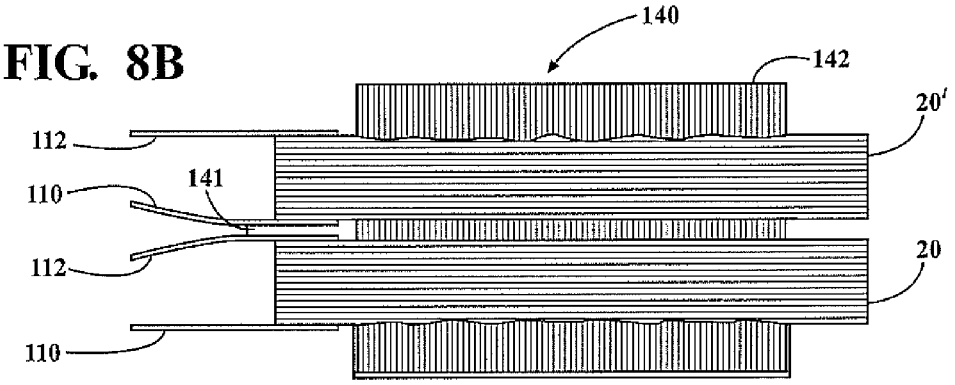
FIG. 8B is a side elevational view showing the input and output terminals for the primary and secondary windings of the transformer shown in FIG. 8A.

The coil 20 shown in FIGS. 1-7 can be employed in an electrical/electronic device as an inductor. Alternately, as shown in FIGS. 8A and 8B, two coils 20 and 20' may be employed as part of a transformer 140, shown in FIGS. 8A and 8B, which includes a core 142. The core 142 may be formed in any configuration, with an E-core 142 formed of a stacked arrangement of E-shaped plates 144 and end linear plates 146 shown by example. Separate input and output terminals or tabs 110 and 112 are attached to select portions of the spiral turns 80 of the coils 20 and 20' in two pairs to form the primary and secondary windings of the transformer 140. The spiral turns 80 of the primary winding are insulated from the spiral turns 80 of the secondary winding in the transformer 140.

One coil 20 can act as a primary winding for the transformer 140; while the adjacent coil 20' can act as a secondary winding for the transformer 140. The space between the coils 20 and 20' can be filled with additional electrical insulation material layer 141 which extends between the facing surfaces of the coils 20 and 20' and also, between the opposed surfaces of the input and output terminals 110 and 112 of the coils 20 and 20'.

It should be noted that the transformer 140 configuration as shown in FIGS. 8A and 8B has the input and output terminals 110 and 112 for the primary and secondary windings or coils 20 and 20', respectively, arranged to extend outward from the coils 20 and 20' along the same side of the coils 20 and 20'.

Figure 9:
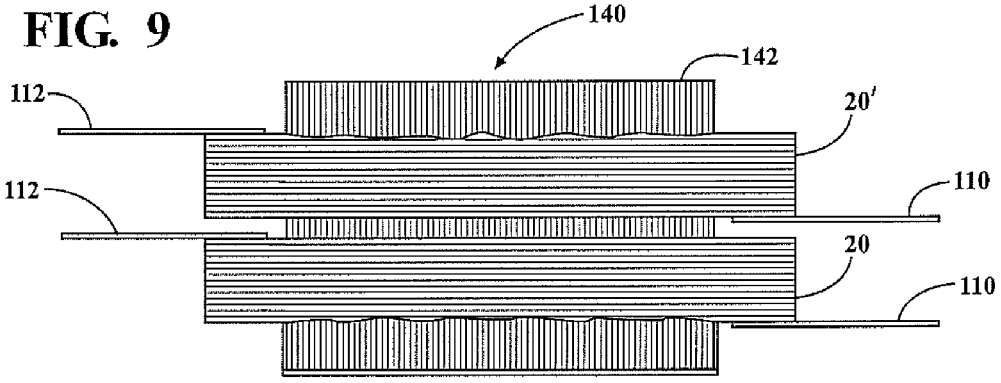
FIG. 9 is a side elevational view, similar to FIG. 8B, but showing an alternate input and output terminal configuration for a transformer.

FIG. 9 depicts an alternate arrangement of the coils 20 and 20' for the transformer 140. In this configuration, one of the coils 20 and 20', such as the lower most coil 20, is rotated 180° from the orientation of the adjacent coil 20'. This allows the input and output terminals 110 and 112 of each of the coils 20 and 20' to project outward from opposite sides of the transformer 140.

Figure 10A:
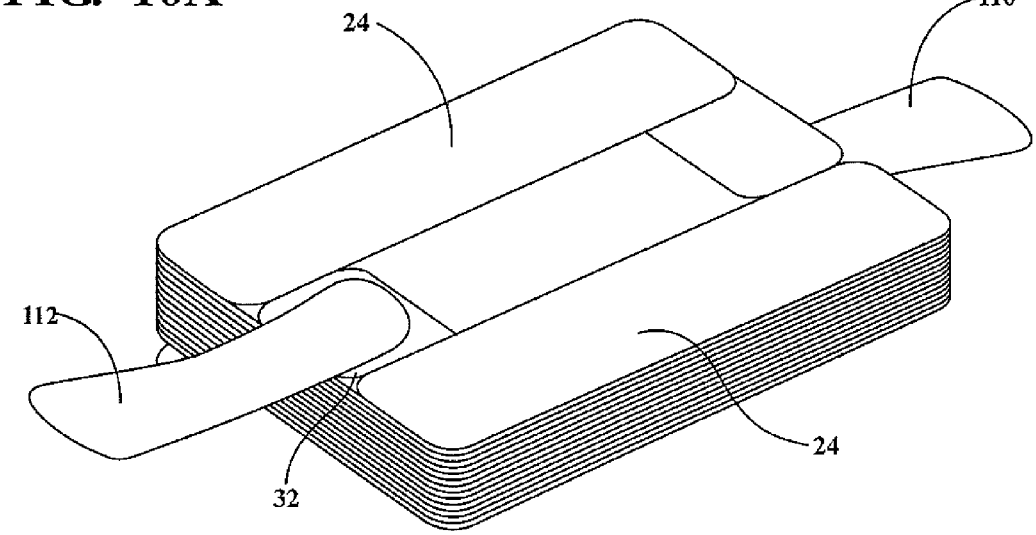
FIG. 10A is a perspective view of an alternate coil construction where the input and output terminals extend from opposite ends of the coil.
Figure 10B:
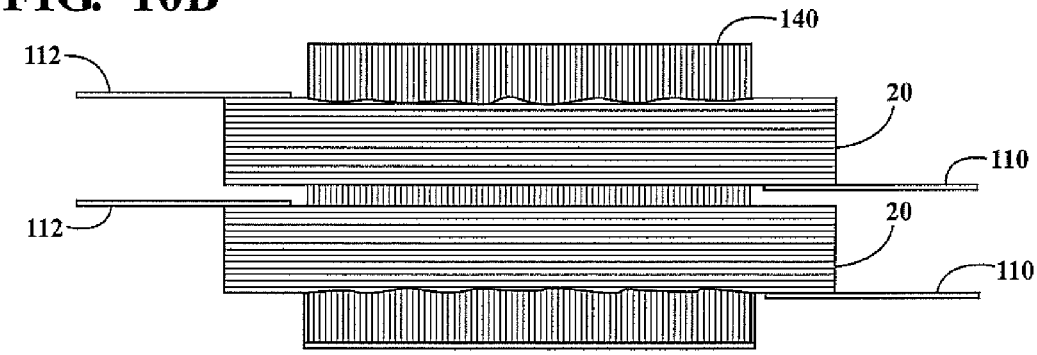
FIG. 10B is a side elevational view showing the use of the coil shown in FIG. 10A in a transformer.

FIGS. 10A and 10B depict an alternate coil construction for the transformer 140 where the input and output terminals 110 and 112 project outwardly from opposite sides or ends of the coils 20 and 20'. This can be achieved by removing two conductors 22 and 24 which constitute a half turn of the coil winding. This exposes a bare portion of the lower most pair of conductors 22 and 24 to allow the input terminal 110 to be attached to the coil 20 and extend outward from the opposite side or end of the coil 20 then the output terminal 112.

Figure 11:
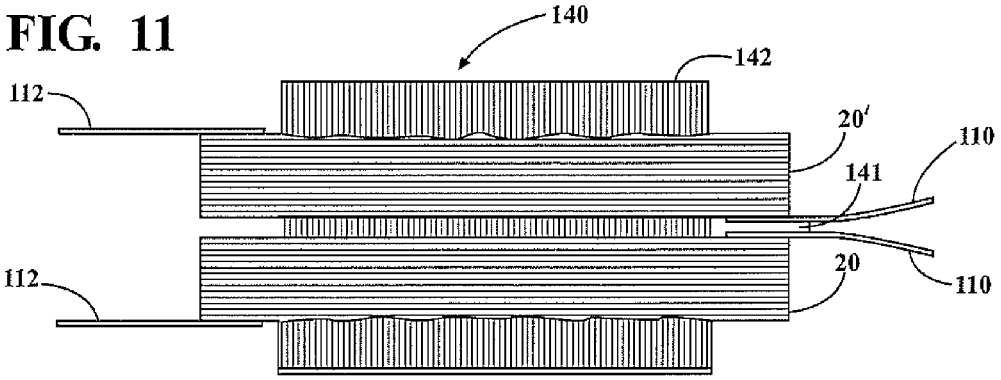
FIG. 11 is a side elevational view, similar to FIG. 9, but showing yet another aspect of a transformer input and output terminal configuration.

FIG. 11 depicts yet another aspect of the transformer 140 where both coils 20 and 20' have one of the input and output terminals, such as the input terminal 110 for example, extending out of the opposite end of the coils 20 and 20' then the respective output terminal 112. As described previously, this can be achieved by removing a half turn from the bottom coil 20 and the top of coil 20 and attaching the input terminal 110 to the exposed bare portion of conductors in each coil 20 or 20'. An insulation layer may be provided between the adjacent input terminals 110 to isolate the primary 20 winding coil from the secondary winding coil 20'.

It will be understood that the fabrication method for constructing a single spiral turn of the coil 20, as described above and shown in FIGS. 6A-6D, is by way of example. The individual conductors 22, 24, 92 and 94 may also be stacked to form a single spiral winding turn 80 of the coil 20 in an opposite orientation where the first conductor 22 is reoriented from the orientation shown in FIG. 6A so that the apertures 64 and 66 are mounted over the posts 72 and 74 of the second set 62 of posts. FIG. 10A also depicts an alternate interleaving or stacking sequence of the conductors 22 and 24. In this alternate stacking method, the first or lower most conductor 22 is orientated 180° from the position of the lowermost conductor 22 shown in FIG. 5. The remaining conductors 24 and 22 forming the coil 20 are also reoriented 180° in the same sequence as described above for the coil 20.

FIG. 10A also depicts an alternate interleaving or stacking sequence of the conductors 22 and 24. In this alternate stacking method, the first or lower most conductor 22 is oriented 180' from the position of the lowermost conductor 22 shown in FIG. 5. The remaining conductors 24 and 22 forming the coil 20 are also reoriented 180' in the same sequence as described above for the coil 20.

What is claimed is:

1. A coil for an electrical and/or electronic apparatus comprising:

a plurality of vertically stacked electrical conductors, each having a linear shape, the plurality of electrical conductors arranged in conductor pairs in a spiral coil configuration;

each conductor pair including a first conductor and a second conductor, the second conductor having an electrically insulating material layer on one major surface;

the first and second conductors inverted relative to each other to form one conductor pair with a bare exposed portion of the one of the first and second conductors of one conductor pair extending outward from the one conductor pair; and alternating conductor pairs partially laterally offset and laterally overlapped with the bare exposed portions of the conductor pairs contacting a stacked bare conductor portion of an adjacent conductor pair to complete a spiral turn.

2. The coil of claim 1 further comprising:

two sets of non-conductive posts, the conductor pairs mounted over the two sets of posts.

3. The coil of claim 2 further comprising:

connectors, mountable on the posts, the connectors forcing a stacked arrangement of conductors into electrical contact to form at least one spiral turn in the coil.

4. The coil of claim 1 wherein:

each of the first and second conductors has a long leg and an angularly disposed short leg portion extending from an end of the long leg.

5. The coil of claim 1 wherein each of the first and second conductors comprises:

an L-shape plate having a long leg and a short leg, the short leg extending perpendicularly from one end of the long leg.

6. The coil of claim 1 further comprising:

two pairs of stacked, partially overlapping and partially laterally offset conductor pair forming a single spiral winding turn, with a centrally disposed aperture between the stacked pairs of conductors.

7. The coil of claim 1 comprising:

alternating conductors having an electrically insulating material layer on one major surface.

8. The coil of claim 7 wherein each of the plurality of flat conductors comprises:

an L-shaped conductor having a long leg and a short leg, the short leg extending perpendicularly from one end of the long leg.

9. The coil of claim 7 wherein:

alternating conductors of the plurality of conductors are inverted relative to adjacent stacked conductors of the plurality of conductors.

10. The coil of claim 7 further comprising:

the plurality of flat conductors arranged in stacked conductor pairs, each conductor in each conductor pair inverted in orientation relative to the other conductor in each conductor pair; and each conductor pair inverted in orientation relative to adjacent stacked conductor pairs.

11. The coil of claim 10 further comprising:

two sets of non-conductive posts, the conductor pairs mounted over the two sets of posts.

12. The coil of claim of 11 further comprising:

connectors, mountable on the sets of posts, forcing the connectors stacked arrangement of conductors into electrical contact to form at least one spiral turn in the coil.

* * * * *